United States Patent [19]

Steele

[11] Patent Number: 4,583,881

[45] Date of Patent: Apr. 22, 1986

[54] MOBILE, OFFSHORE, JACK-UP, MARINE PLATFORM ADJUSTABLE FOR SLOPING SEA FLOOR

[75] Inventor: James E. Steele, Quakertown, Pa.

[73] Assignee: Bethlehem Steel Corporation, Bethlehem, Pa.

[21] Appl. No.: 614,585

[22] Filed: May 29, 1984

[51] Int. Cl.[4] ..... E02B 17/08

[52] U.S. Cl. ..... 405/198; 405/196; 405/203; 405/227

[58] Field of Search ..... 405/196–198, 405/203, 204, 205, 207, 208, 224, 227

[56] References Cited

U.S. PATENT DOCUMENTS

| | | | |
|---|---|---|---|
| 2,352,370 | 6/1944 | Carruthers | 405/204 |
| 2,953,904 | 9/1960 | Christenson | 405/196 |
| 2,995,900 | 8/1961 | Hunsucker | 405/203 |
| 3,289,419 | 12/1966 | McGowen | 405/203 X |
| 3,290,007 | 12/1966 | Yeilding | 405/198 X |
| 3,927,535 | 12/1975 | Giblon | 405/203 |
| 4,224,005 | 9/1980 | Dysarz | 405/196 |
| 4,255,069 | 3/1981 | Yielding | 405/196 |
| 4,445,805 | 5/1984 | Ray et al. | 405/196 |

FOREIGN PATENT DOCUMENTS

| | | | |
|---|---|---|---|
| 209196 | 5/1960 | Austria | 405/196 |
| 2019985 | 11/1971 | Fed. Rep. of Germany | 405/196 |

*Primary Examiner*—Dennis L. Taylor
*Attorney, Agent, or Firm*—John J. Selko

[57] ABSTRACT

A mobile, offshore, jack-up, marine platform, adjustable for sloping sea floor having a mat, a multilegged column pivotally connected thereto and a work platform slidably mounted on the column. Means are included for independently vertically adjusting at least one leg and for selectively cantilevering a drilling unit on the work platform, with offset ballasting of the work platform.

14 Claims, 27 Drawing Figures

MOBILE, OFFSHORE, JACK-UP, MARINE PLATFORM ADJUSTABLE FOR SLOPING SEA FLOOR

BACKGROUND OF THE INVENTION

This invention relates to mobile, offshore, jack-up, marine platforms of the type used to explore for and produce oil and natural gas from locations under the sea, and particularly from locations under substantial depth of sea water, such as depths of about six hundred feet. Such locations may have sloping sea floor which would cause unacceptable tilting out of vertical of a platform mounted on a central column which is connected to a mat positioned on the sea floor. Such platforms need to be adjustable for sloping sea floor, with a central column rigidly cross-braced to withstand wind and wave action upon the long central column. The apparatus of this invention satisfies the aforementioned needs.

SUMMARY OF THE INVENTION

The apparatus of this invention provides a jack-up marine platform for use as a drilling rig having a central column tiltable by means of legs independently pivotally fastened to a mat positioned on the sea floor. The work platform includes a cantilevered feature comprised of fixed cantilevered arms and a universally movable skid further cantileverable along the arms. The work platform can be selectively ballasted based upon skid cantilever location. Means are included for independently raising and lowering each leg in relation to the mat, which means are sealed within each leg. Cross-bracing of the column can include at least one pivotally connected set of struts, to permit "flexing" of column as each leg is independently vertically adjusted.

BRIEF DESCRIPTION OF THE DRAWINGS

FIG. 9(*a*) is the same view as FIG. 9 but showing the lower portion of the jack-up means, with parts removed.

FIG. 10(*a*) is a schematic elevation, with parts removed, partially in cross section showing a first means for vertically adjusting the leg.

FIG. 12(*a*) is a same view as FIG. 12 but showing the lower part of one means for pivotally connecting a leg to the mat, with parts removed.

FIG. 18(*a*) is cross section elevation of the spud anchoring device of FIG. 18.

FIG. 19(*a*) is the same view as FIG. 19, showing the lower portion of leg pivotally connected to the mat.

DESCRIPTION OF PREFERRED EMBODIMENT AND BEST MODE

General Arrangement

Figure 1:
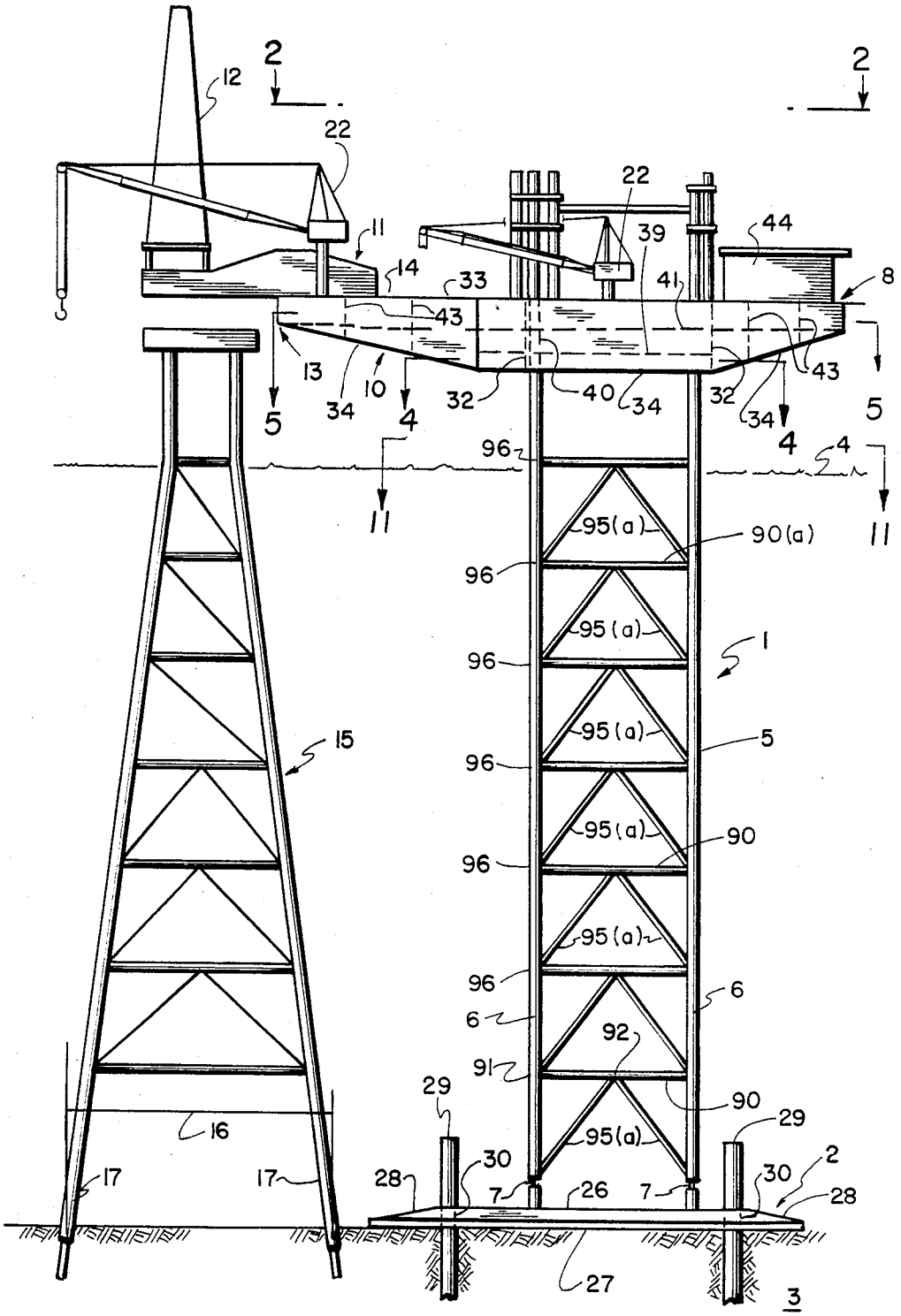
FIG. 1 is a schematic elevation of the drilling rig of this invention in position next to a production tower.

Referring to FIG. 1, there is shown the drilling rig 1, having a mat 2, for resting on bottom 3 below surface of water 4. Fastened to mat 2 is a central column 5, pivotally attached to mat 2. Each chord (or leg) 6 is pivotally fastened at connection 7, as will be described hereinafter. I prefer central section 5 to be comprised of three legs arranged such that central section in horizontal cross-section is a three-legged triangular column. A four-legged square or rectangular cross-sectional column could be used also.

Column 5 extends vertically upward in excess of six hundred feet from mat 2 to extend above the surface of water 4. The height of column 5 is arbitrary, and is selected based upon the depth of water drilling rig 1 is to operate within.

Figure 2:
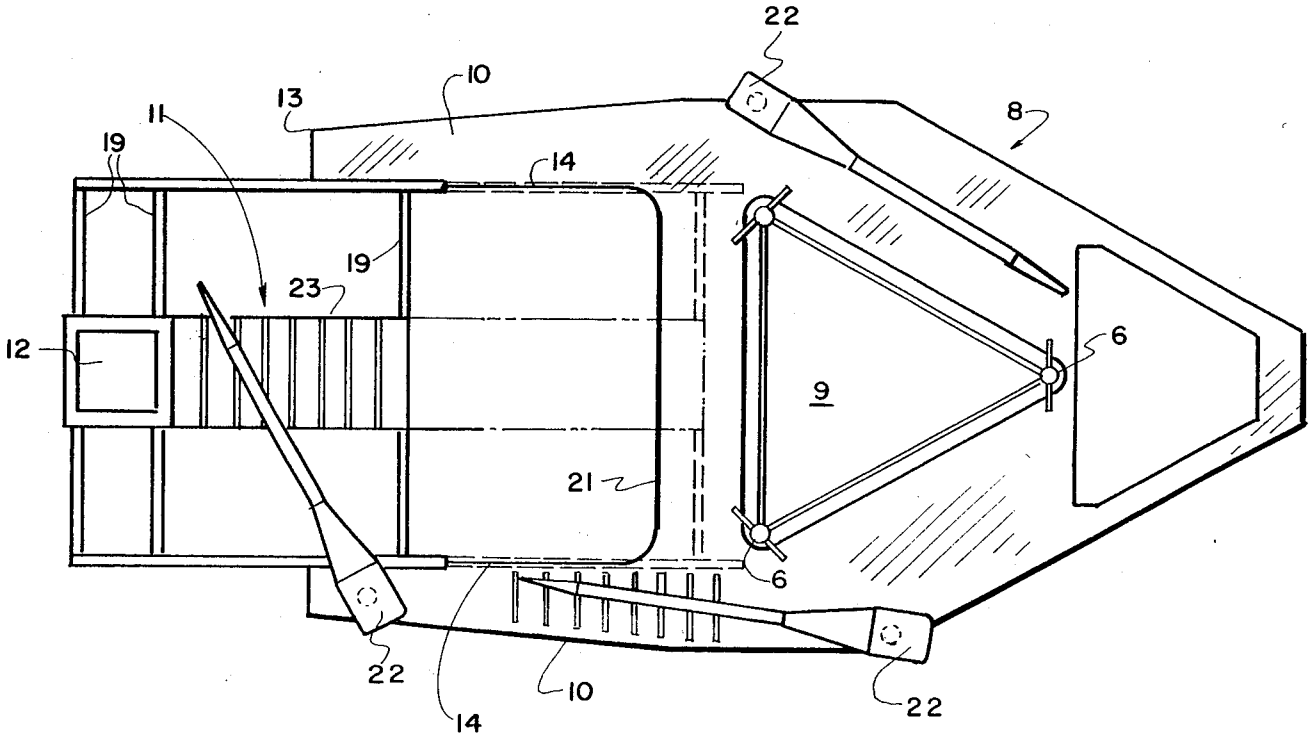
FIG. 2 is a schematic plan view of the top deck of the working platform, along lines 2—2 of FIG. 1.

Slidably mounted on column 5 is jack-up work platform 8. As shown in FIG. 1 and 2, work platform 8 is mounted on column 5 so that column 5 extends through central portion 9 of work platform 8. Work platform 8 includes a pair of fixed, parallel cantilevered arms 10 extending outwardly from central portion 9 of work platform 8.

Movably mounted on work platform 8 is skid unit 11 carrying drilling equipment 12. Skid unit 11 is movable by conventional means (not shown) in a direction parallel to cantilevered arms 10. As shown in FIG. 1, skid unit is movable to approximately the edge 13 of fixed cantilevered arms 10 on tracks 14, to permit location of skid unit a substantial distance away from column 5. Thus, it is understood that cantilevered position of skid unit 11 includes a fixed portion (arms 10) and a movable portion, such that skid unit 11 can be moved along tracks 14 from adjacent the central portion 9 of work platform 8 to an extreme cantilevered portion outboard beyond end 13 of arms 10, as shown in FIG. 1. Skid unit 11 is moved toward central portion 9 during towing and positioning of drill rig 1, and skid unit 11 is moved to extreme cantilivered position when drilling rig 1 is positioned for working vertically above a drilling production tower shown generally as 15 in FIG. 1.

Because of the great depth of water, tower 15 extends upwardly a great distance, and requires a significant span of distance 16 between legs 17 for stability. Mat 2 can only extend to legs 17 on bottom 3 and fixed cantilevered arms 10 plus movable cantilevered skid unit 11 must extend outwardly beyond mat 2 a sufficient distance to permit drilling equipment 12 to reach vertically above top of production tower 15.

Figure 3:
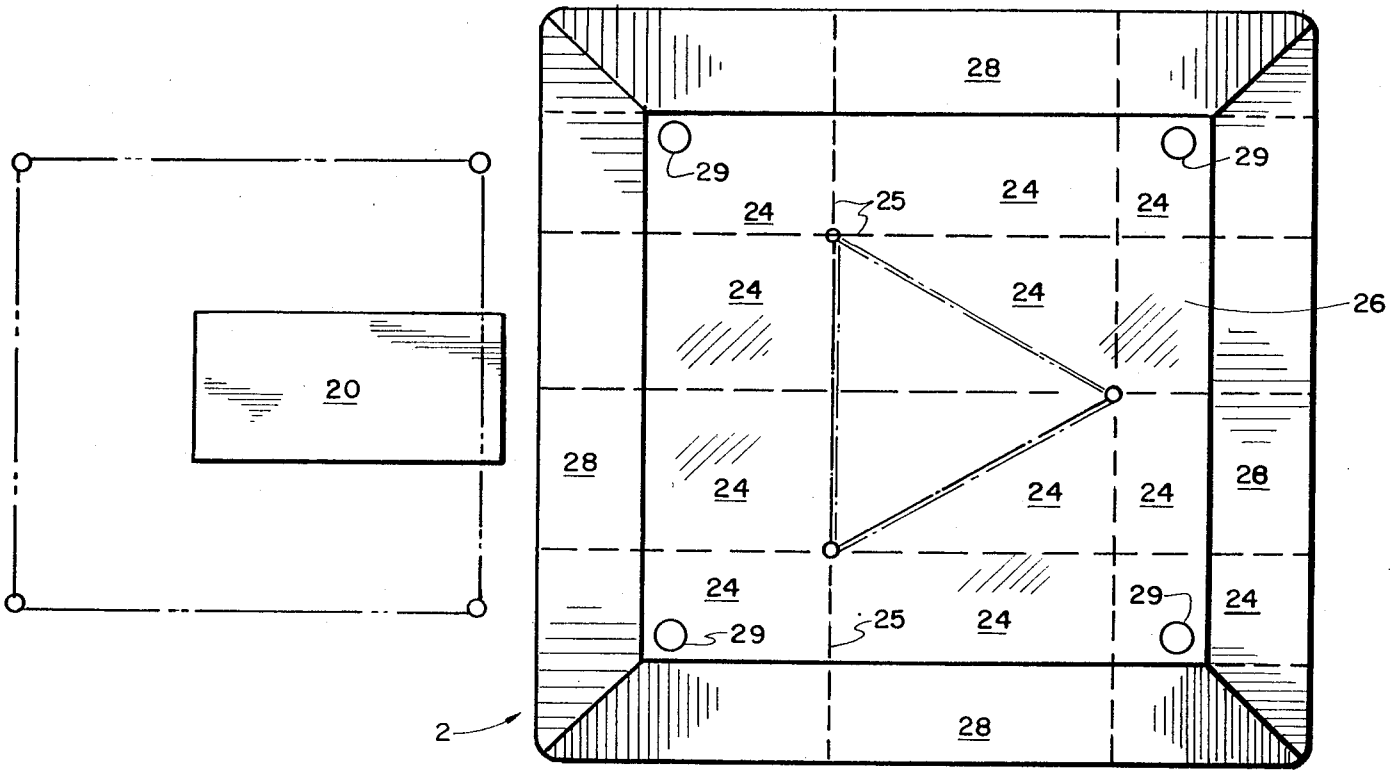
FIG. 3 is a plan view of the mat.

As shown in FIG. 2 and FIG. 3, drill unit 12 is movably mounted on rails 19 which laterally span fixed arms 10. Skid unit 11 is thus universally horizontally movable by reason of drill rig 12 ability to move along rails 19, in connection with movability of skid unit 11 along arms 10 on rails 14. Work area 20 between arms 10 and outboard of edge 21 of central portion 9 is serviced by universally movable skid unit 11, and work area 20 extends outwardly from between arms 10 by reason of the ability of skid unit 11 to be cantilevered out past edge 13 of arms 10. Thus, the combination of fixed and movable cantilevered skid unit means significantly increases the work area serviced by skid unit 11, a very important advantage for large structures required for deepwater drilling.

It should be understood that the means for moving skid unit 11 and drilling rig 12 are not shown in detail because such means are conventional and can be achieved by means well known to those skilled in the art of marine drilling rig design. Also mounted on work platform 8 are conventional cranes 22, in various location, as is well known. Mounted on skid unit 11, is pipe storage rack 23. Storage rack 23 is shown located between drill rig 12 and central portion 9 of platform 8, and storage rack 23 moves with drill rig 12.

The Mat

As shown in FIG. 1 and 3, mat 2 is essentially rectangular in plan view. Mat 2 is constructed with a plurality of hollow, water-tight chambers 24 defined by intersecting plates 25 and top and bottom surfaces 26 and 27 of mat 2. Chambers 24 are equipped with conventional valve means (not shown) which can be opened and closed in order to selectively admit sea water for the purpose of flooding mat 2 at selected times. The valve means are operable from the working platform 8 by means of conventional connections (not shown) such as hydraulic controls, when mat 2 is in the raised position next to surface 4. Also operably connected to chambers 24 are conventional means (not shown) for forcing air into one or more chambers 24 for the purpose of expelling sea water from chambers 24 in order to deballast mat 2, so as to reduce the weight thereof. Means for forcing air into chambers 24 is also operably connected to work platform 8, so as to be operable when mat 2 is adjacent to surface 4.

Mat 2 is equipped with sloping surfaces 28 for reducing water resistance during towing of mat 2 to location, as well as for minimized resistance to underwater currents, when mat 2 is on bottom 3.

Also shown on mat 2 are optional spuds 29 extending through mat 2 for anchoring mat 2 into bottom 3. Spuds 29 are raisable and lowerable through channels 30 in mat 2 by means of crane 22 on work platform 8. Spuds 29 can be lowered into position by crane 22 when mat is floating near surface of water 4. After spuds are positioned, pins (not shown) can be inserted between spuds 29 and mat 2 to lock spuds 29 into position.

Figure 18:
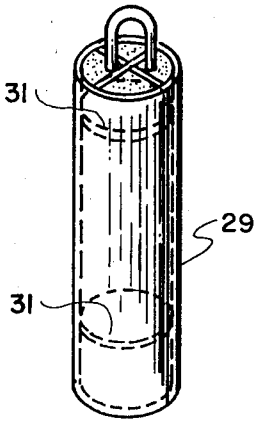
FIG. 18 is an isometric view of a spud anchoring device.
Figure 18:
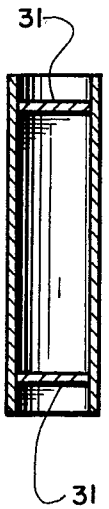

As shown in FIG. 18 and 18(*a*), spuds 29 are preferably hollow, tubular in cross-section having internal heads 31 sealingly located therein to provide internal water-tight compartments to aid in floating and removal of spuds 29.

The Work Platform

Figure 4:
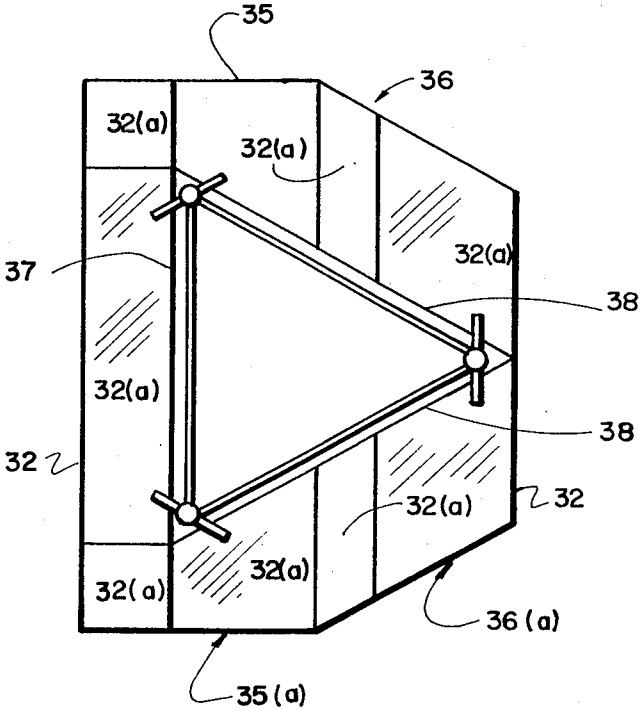
FIG. 4 is a cross section through the working platform along lines 4—4 of FIG. 1.

As shown in FIG. 1 and FIG. 4, work platform 8 is comprised of a plurality of compartments formed by interconnected vertically extending plates 32 (FIG. 1) welded to top and bottom decks 33 and 34 respectively. As seen in FIG. 1 and FIG. 4, plates 37 extend vertically between top and bottom deck 33 and 34, as well as longitudinally between sides 35 and 35 (*a*). Plates 38 extend vertically between decks 33 and 34 as well as longitudinally between plate 37 and 32. In combination, the plates 37 and 38 form the inner wall of first below deck work area, as well as the opening in central area 9 of work area 8 for passage of central column 5. Horizontally extending plates 32 (*a*) are welded between sides 35 and 35 (*a*) as well as 36 and 36 (*a*) of work platform 8. In combination, the plates 32, 32 (*a*) extending vertically between decks 33 and 34 and extending horizontally between sides 35, 35(*a*), 36 and 38 form a first work area between top and bottom decks 32 and 33. As shown in FIG. 1, first below deck work area can be divided into a plurality of work levels and work rooms by appropriately located horizontal deck plates 39 and vertical wall plates 40.

Figure 5:
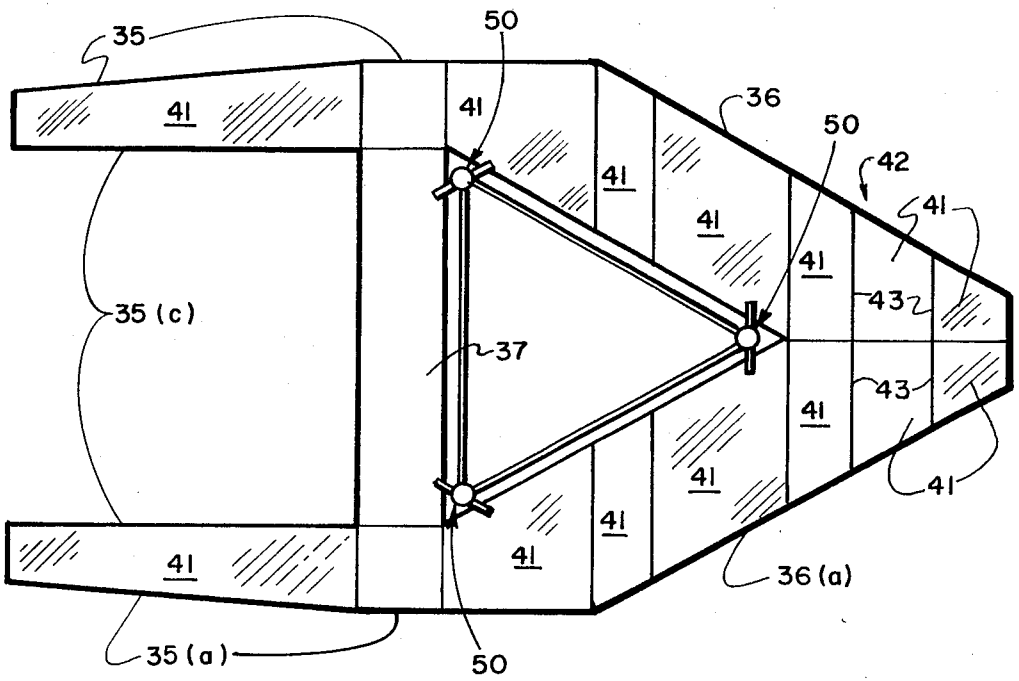
FIG. 5 is a cross section through the working platform along lines 5—5 of FIG. 1.

As shown in FIG. 1 and FIG. 5, a second below deck work level is provided by horizontally positioned plate 41 extending parallel to top deck 33 and bottom deck 34 in central portion 9. Plate 41 extends between plates 35 and 35(*a*); 35, 35(*a*) and 38; 36, 36(*a*) and 38. By apex end 42, is meant the end corresponding to an apex formed by triangularly placed column legs 6. It will be understood that triangular column 5 has a pair of legs 6 placed adjacent each cantilevered arm 10, forming the base of an equilateral triangle (as viewed in horizontal cross section), with the third leg 6 placed opposite arms 10 to form the apex of the aforementioned triangle.

Each cantilevered arm 10 is formed into a plurality of hollow compartments by plates 35, bottom deck 34 and inner arm surface plates 35 (*c*). Second below deck level work area is further divided into a plurality of compartments by plates 43 vertically extending between top and bottom deck 33 and 34.

Each of the compartments in apex end 42 are ballastable, that is, equipped with conventional valve means and pumping means (not shown) which can be used to fill and empty the compartments.

The compartments in each cantilevered arm 10, particularly those compartments adjacent outer end 13, are kept empty, since the cantilevered arms 10 are ballasted by the weight of cantilevered skid unit 11 and drill equipment 12.

Apex end 42 includes a plurality of ballastable compartments which are used as ballast, while arms 10 are also comprised of a plurality of compartments which are empty adjacent outer end 13. Ballasted apex end 42 is selectively filled and emptied with ballast water in conjunction with how far skid unit 11 is cantilevered out along arms 10. Living quarters 44 are positioned over apex end 42 to add ballast.

The location of equipment in the remaining below-deck compartments as well as on the work deck itself is distributed so as to provide weight generally evenly distributed around column 5. Thus, there is provided, in connection with ballastable compartments of apex end 42 and empty compartments of arms 10 a drill rig of enhanced ability to reach far out over a drill tower and still keep the center of the load over the center of the column 5 and mat 2, a very important feature for deep water structures.

It is preferred that central column is triangular in cross-section but it could be square or rectangular, in which case apex end 42 would be replaced by a second pair of legs 6 spaced parallel to the first pair of legs adjacent arms 10. The ballastable compartments would be adjacent the second pair of legs 6.

The Jack-Up Mechanism

As shown in FIG. 5, located on each leg 6 of column 5 is a jack-up mechanism 50 for moving work platform up and down in relation to mat 2 and column 5.

The jack-up means 50 includes a movable semicircular yoke 51 (FIG. 6 and 7) spaced from and spanning an outer periphery 6(*a*) of hollow-tubular leg 6 of column 5. Yoke 51 spans outer periphery 6 (*a*) because the inner periphery is taken up with cross bracing members, as will be described hereinafter.

Movable yoke 51 includes upper bracket 52 and lower bracket 52(*a*) fixedly connected together by vertically extending side plates 53. Fastened to sideplates 53 in opposing relationship at the diametrically opposed positions on leg 6 is a first and second pin box 54 and 55. Each pin box is essentially the same, and the description of one pin box 54 or 55 also describes the other.

Figure 8:
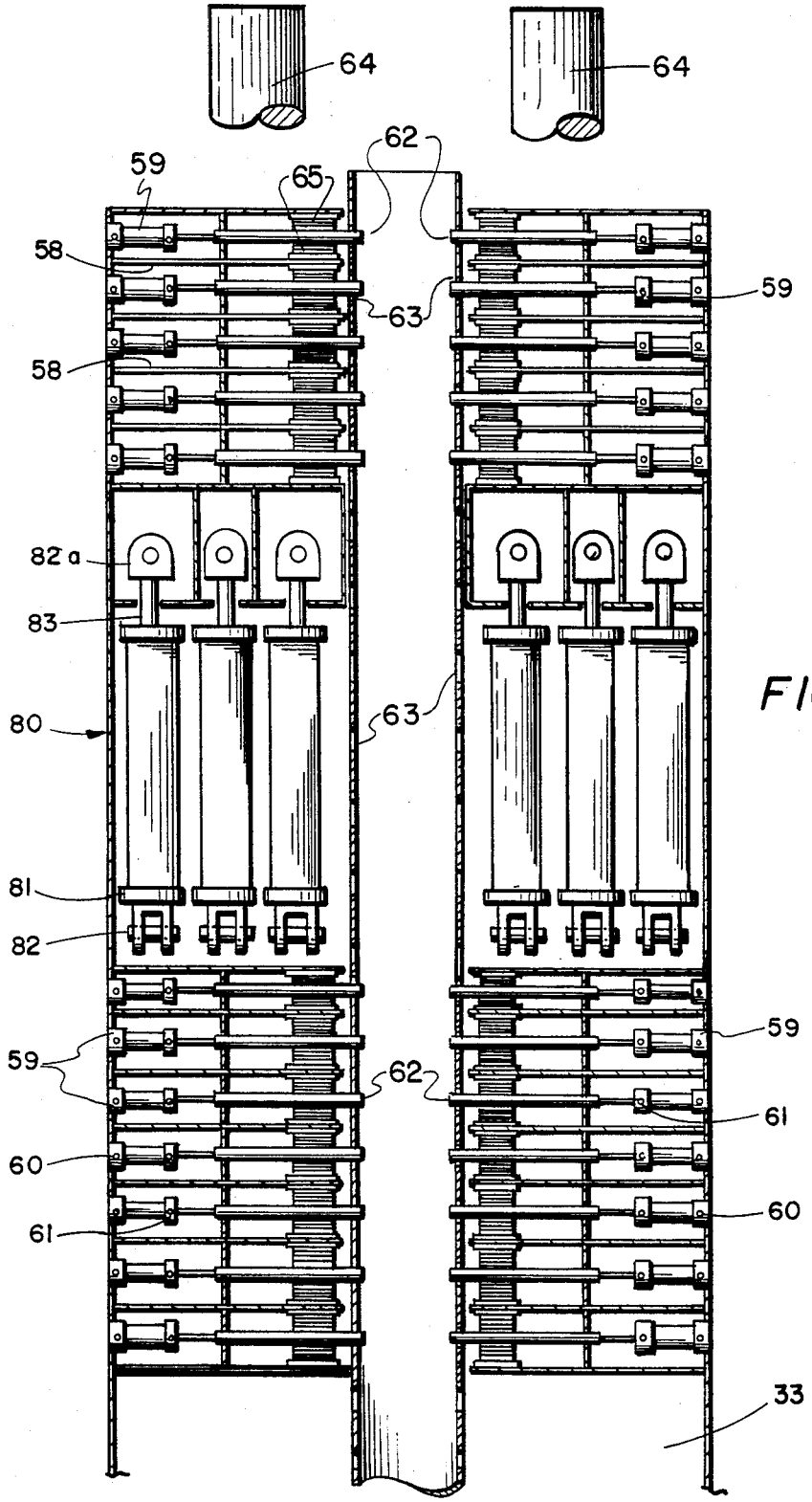
FIG. 8 is a cross section, with parts removed, through the jack-up means along line 8—8 of FIG. 7.
Figure 9:
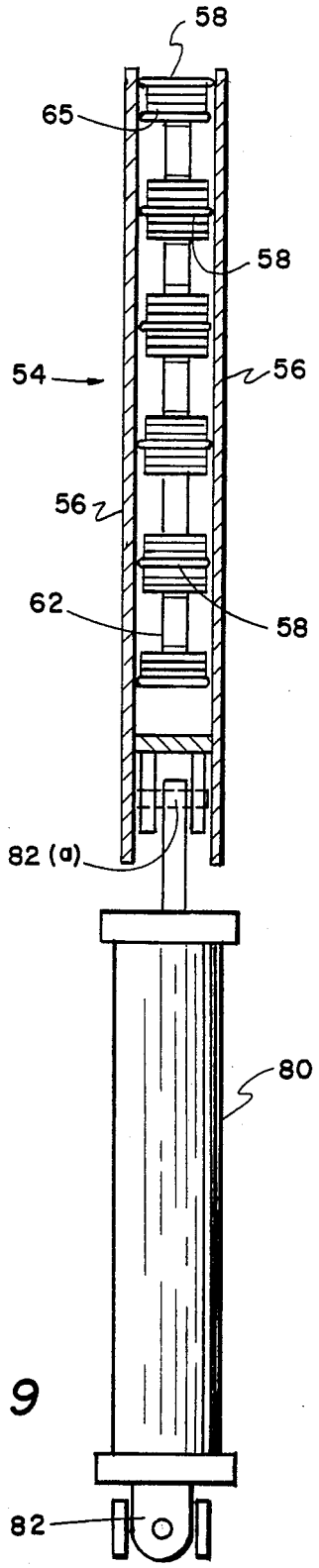
FIG. 9 is a cross section, with parts removed, through the jack-up means along line 9—9 of FIG. 6.
Figure 9:
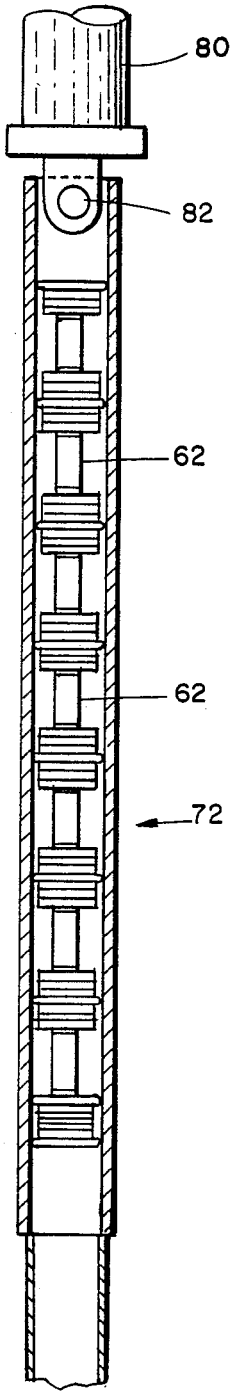

Pin box 55 includes vertically extending side plates 56 rigidly connected together by end plates 57. Each pin box 55, is a rigid hollow member, generally rectangular in horizontal cross section, further divided into a plurality of vertically spaced compartments by horizontally extending pin box plates 58 (FIG. 8). Fixedly mounted within each compartment is a horizontally-oriented hydraulically-operated cylinder and pin assemblies 59,62. Cylinder and pin assembly 59,62 is operated by conventional hydraulic means, such as air, through conventional inlet and outlet ports 60, 61 to operate anchor pin 62 selectively into and out of diametrically opposed slots 63 in leg 6. Thus, each pin box 54,55 carries a plurality of vertically-spaced, horizontally-oriented piston and cylinder assemblies to selectively drive anchor pins 62 into and out of vertically spaced openings 63 in leg 6. It would be equivalent to provide a cylinder which is capable of driving more than one anchor pin 62, up to and including all such anchor pins in a given pin box.

Movable yoke 51 is free to move vertically along leg brackets 52, 52 (*a*) of yoke 51 are two vertical guide posts 64, which extend parallel to leg 6 and which are permanently fastened to top deck 34 by conventional means.

Also within pin boxes 54, 55 surrounding pins 62 and extending between cross plates 58 are elastic absorption pads 65 to absorb force. These pads 65 act as springs. The structure would have to be very precisely made if the pins 62 rested on metal to metal. Inserting elastic pads 65 reduces the accuracy required and permits all pins 62 to share the load equally.

Figure 6:
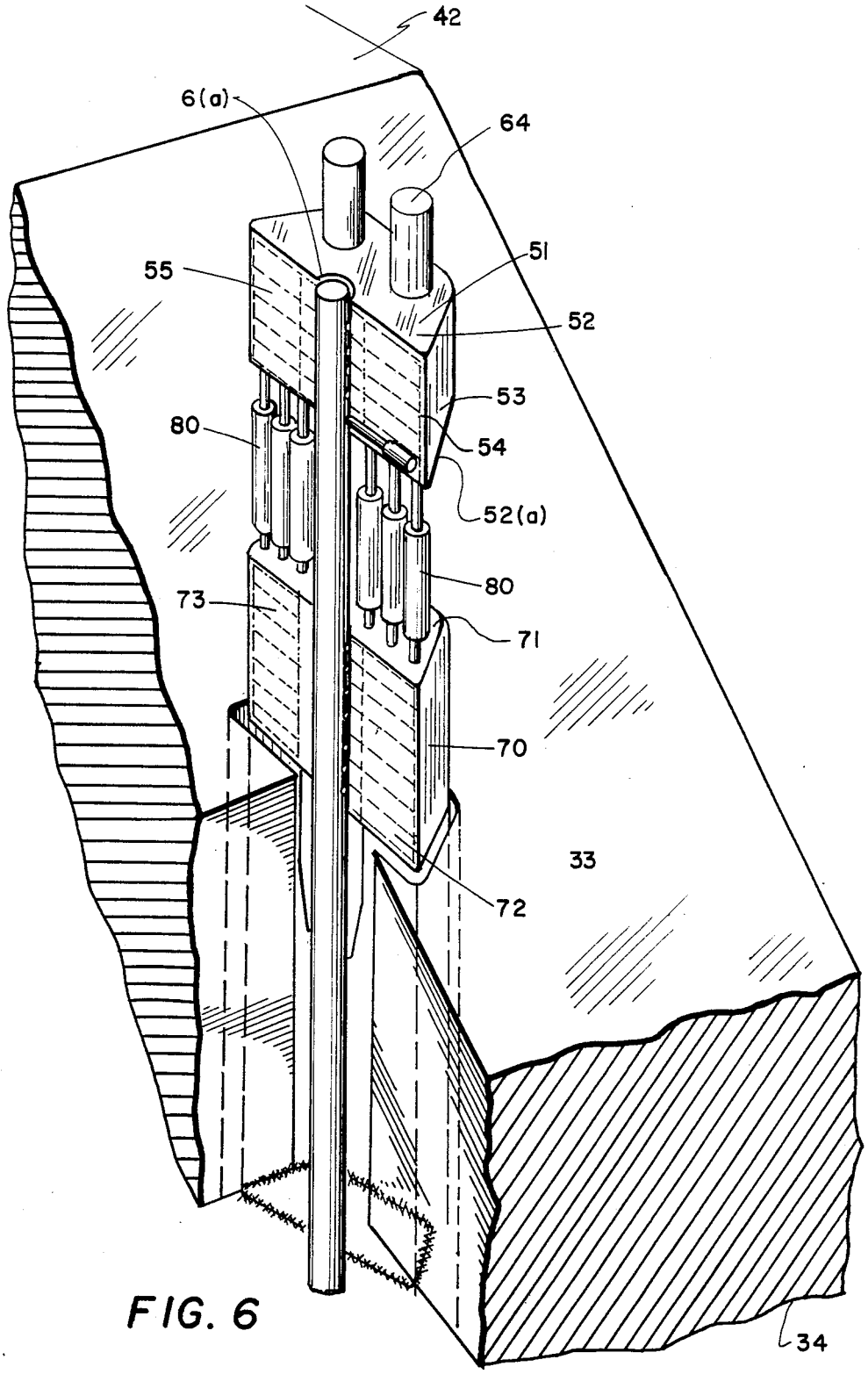
FIG. 6 is a perspective schematic view of a jack-up means used to move work platform up and down with respect to mat and column of the platform.
Figure 7:
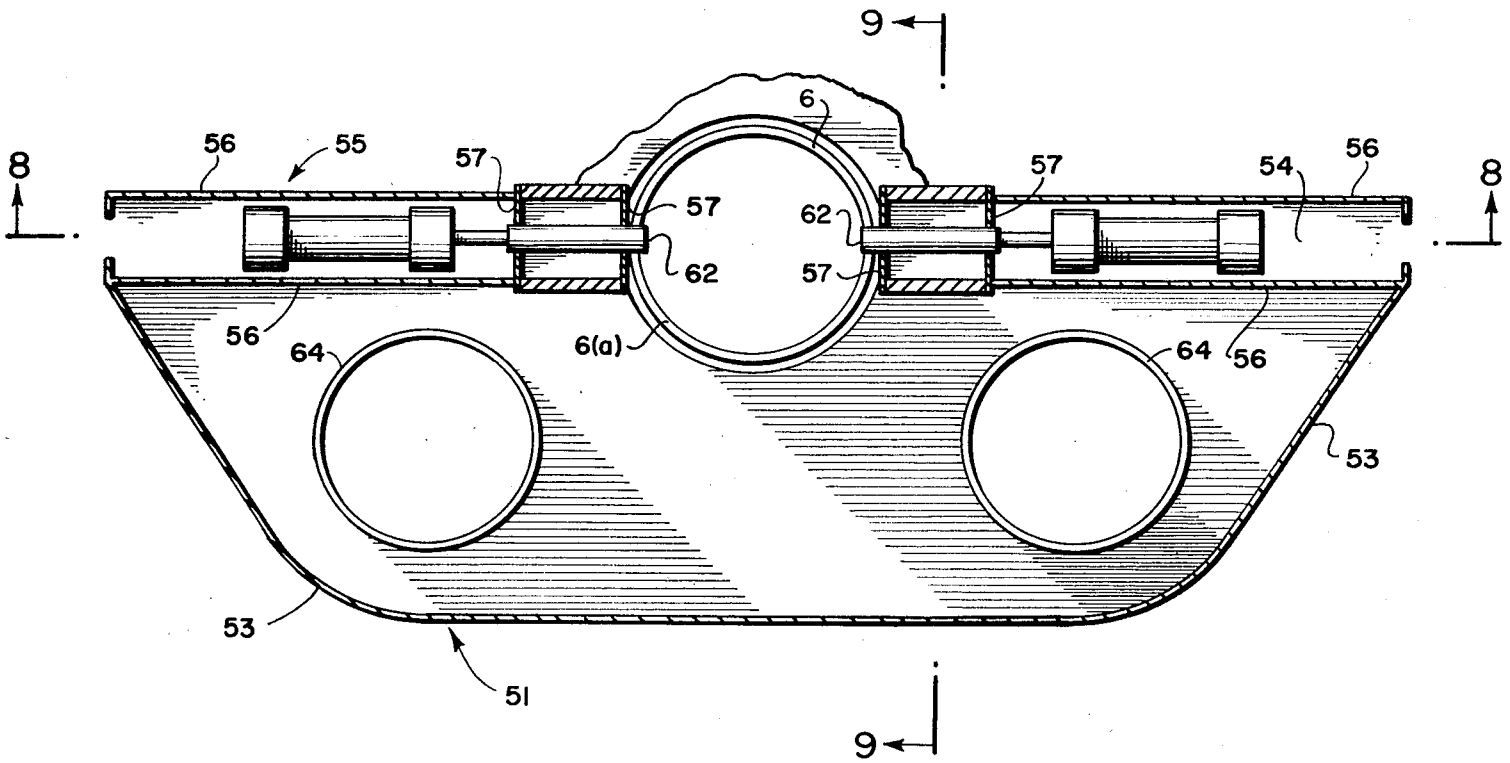
FIG. 7 is a plan view in partial cross section of the movable yoke of the jack-up means of FIG. 6.

Spaced vertically below first semicircular movable yoke 51 is a second semicircular yoke 70, which is fixed. Fixed yoke 70 also is spaced from and spans outer portion 6 (*a*) of leg 6, and has a top bracket 71. Guide posts 64 also extend through openings in top bracket 71. Permanently fastened to top bracket 71 are pin boxes 72 and 73 which are spaced vertically directly below corresponding pin boxes 54, 55 on movable yoke 51. Pin boxes 72, 73 are constructed similarly to pin boxes 52, 53 described above. However, pin boxes 72, 73 extend vertically downward through slots in top deck 33 and any intervening plates in work areas below top deck 33, with each pin box contacting lower deck 34, where each pin box is permanently affixed to lower deck 34 (FIG. 6). Thus, it should be understood that fixed yoke 70 is permanently attached to work platform 8, and as fixed yoke 70 moves up and down in relation to legs 6, entire work platform 8 also so moves up and down.

Located within each pin box 72, 73 is a plurality of vertically-spaced, horizontally-oriented hydraulic cylinder and pin assemblies 59, 62, for selectively engaging opening 63 in leg 6 by means of anchor pins 62. It should be understood that the detailed structure (internally and externally) of pin boxes 72, 73 is similar to that described for pin boxes 54, 55 hereinabove, and will not be repeated here. It is preferable that each pin box 72, 73 includes seven horizontally-oriented cylinder and pin assemblies, while each pin box 54, 55 includes five such assemblies. Fixed yoke 70 carries seven anchor pins 66, as opposed to five on movable yoke 51 for stability, because fixed yoke 70 will carry the increased load due to preloading and to drilling when the platform 1 is in operable position.

Interconnecting the first and second yokes, 51 and 70, is a plurality of vertically-oriented hydraulic piston and cylinder assemblies 80. A description of one assembly 80 will suffice for all, since all are the same. Assembly 80 has its base 81 pivotally attached to top bracket 71 of fixed yoke 70, by means of clevis and pin assembly 82, of conventional design. Clevis and pin assembly 82 provides a pivotable connection between cylinder assemblies 80 and pin boxes 72, 73 on fixed yoke 70 to adjust for slight misalignments between legs 6 and work platform 8.

Upper piston rod 83 is also pivotally fastened to bottom bracket 52 (*a*) of movable yoke 51, by means of a second conventional clevis and pin arrangement 82 (*a*). By reason of first and second clevis and pin arrangements 82 and 82 (*a*) piston and cylinder assemblies are universally pivotal to permit adjustment for misalignment between legs 6 and jack-up means 50. I prefer to provide three such piston and cylinder assemblies 80, between each pair of upper pin boxes 54, and its corresponding lower pin box 72, and 55/73 respectively. A different number of such piston and cylinder assemblies can be chosen depending upon the anticipated load to be carried and moved.

The Column

Figure 10:
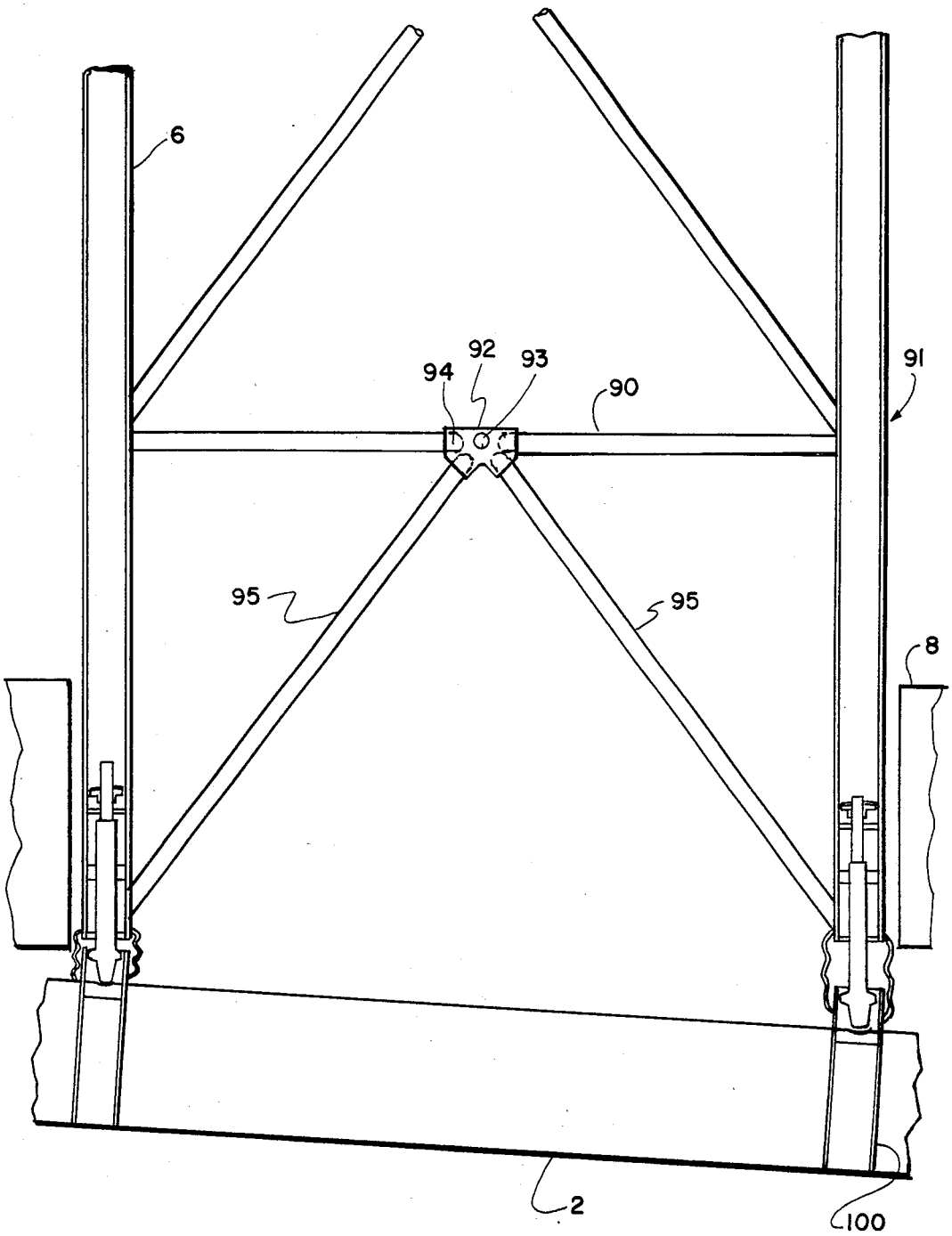
FIG. 10 is a schematic elevation, with parts removed, partially in cross section, with parts remcved, of the column showing legs pivotally to the mat and pivotal cross bracing.
Figure 10:
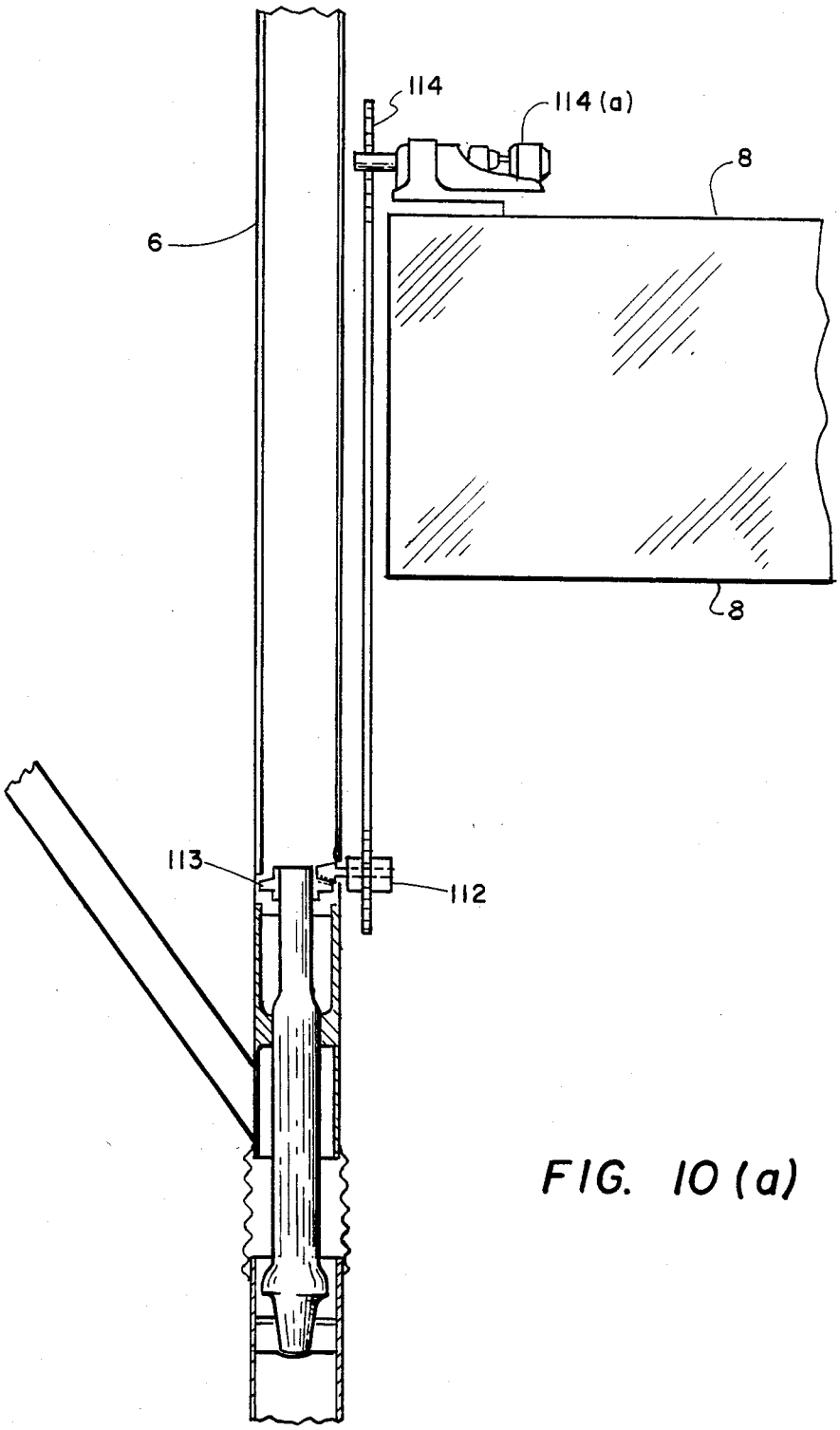
Figure 11:
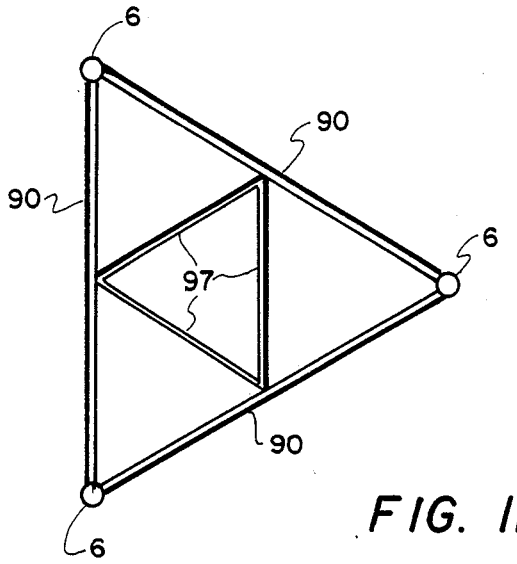
FIG. 11 is a cross section, with parts removed, through the column along line 11—11 of FIG. 1.

As shown in FIG. 1, FIG. 10 and FIG. 11, column 5 is preferably a three-legged, cross-braced, tower, being triangular in horizontal cross-section, the tower having vertical legs 6 formed from hollow tubular members. Connecting each pair of legs 6 is a horizontally disposed outer strut 90 in a first horizontal plane 91 adjacent mat 2. Outer strut 90 is preferably formed from two pieces which are pivotally connected at midpoint 92 by means of conventional pin 93 and bracket 94. Also pivotally fastened at mid point 92 is a pair of diagonal struts 95, each diagonal strut 95 extending diagonally downward to fixedly connect to a different leg of the pair of legs 6. The arrangement of outer struts 90 and diagonal struts 95 is shown pivotally connected at the first horizontal level of struts above the mat 2. At successive elevations 96 above the first level 91, the outer struts 90 (*a*) are similarly located and disposed with respect to each pair of legs 6. Likewise, each pair of diagonal struts 95 (*a*) is also similarly located and disposed to struts 95 hereinbefore described. However, at each successive elevation 96 struts 90 (*a*) and 95 (*a*) are *fixedly* connected at midpoints whereas struts 90 and 95 are preferably pivotally connected. The reason for pivotal connection will become apparent hereinafter when vertical adjustment of tower legs 6 is explained. Finally, fixedly connecting each pair of horizontal outer struts 90 or 90 (*a*) at the midpoint of strut 90, 90 (*a*) in a given plane, is an inner strut 97 (see FIG. 11) generally horizontally disposed.

In combination, the three legs 6, cross-braced at a given horizontal plane by outer horizontal struts 90, 90 (*a*), diagonal struts 95, 95 (*a*) and inner horizontal struts 97 provide a single tower, cross braced independently from the adjustable working platform 8. Such independent cross bracing, which does not rely on cross bracing support from work platform 8, provides significant stiffness against wind and wave action, when the mat 2 is located on bottom 3, about six hundred feet below surface of water 4.

As described above, the column could also be four-legged and square or rectangular in horizontal cross-section.

The Tilting Mechanism

Figure 12:
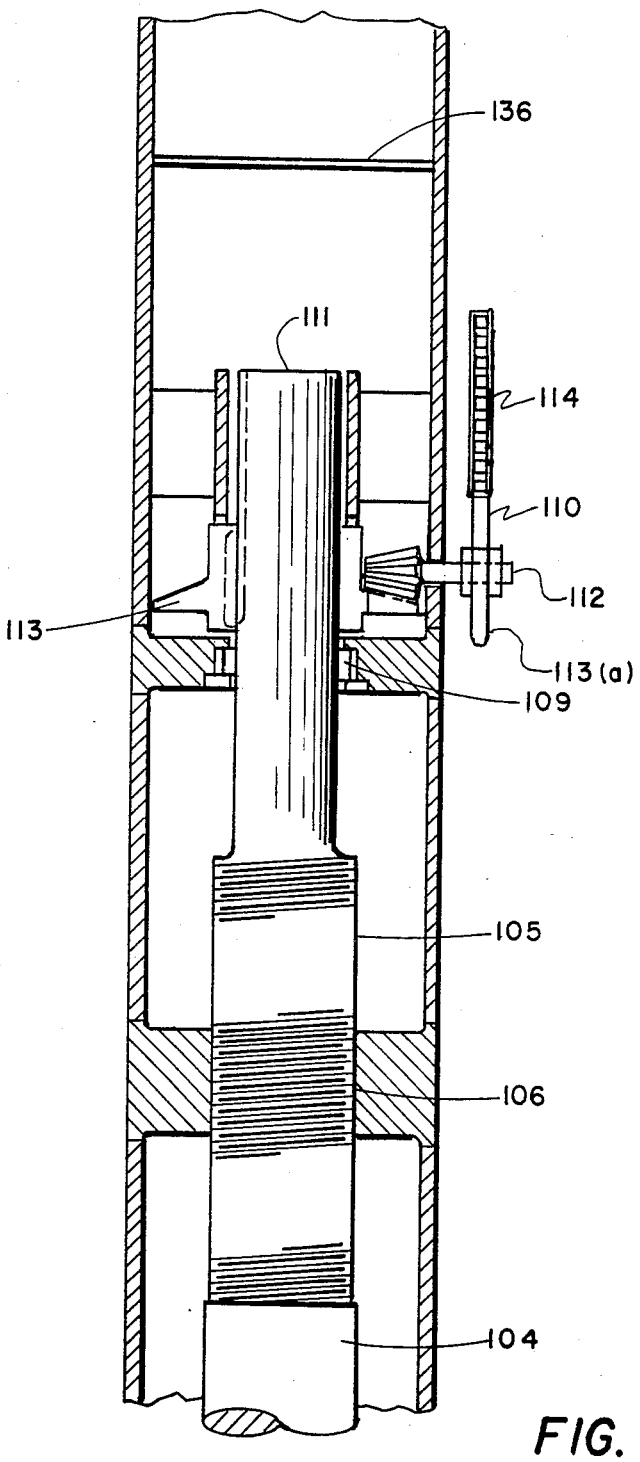
FIG. 12 is a schematic elevation, with parts removed, partially in cross section of the column showing the upper part of one means for pivotally connecting a leg to the mat including a first means for vertically adjusting the leg.
Figure 12A:
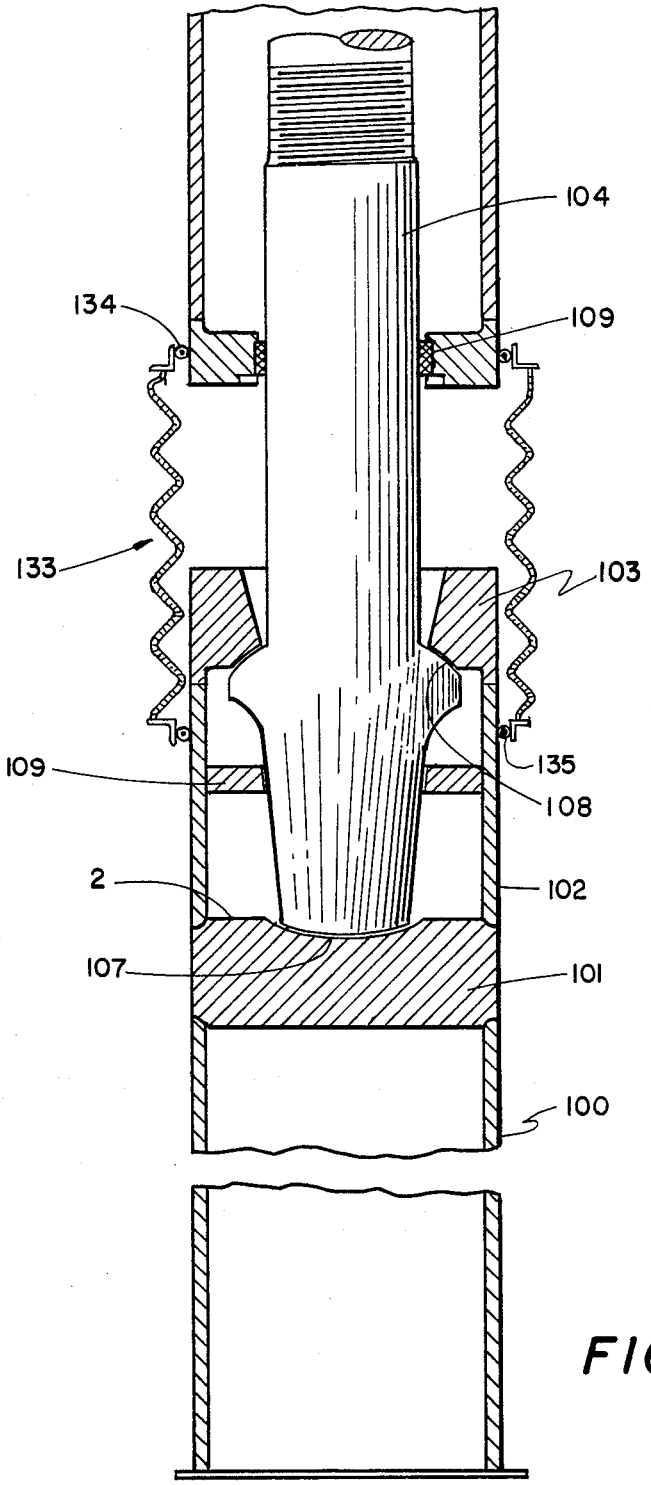

As shown in FIGS. 10, 12 and 12(*a*), one means for tiltably adjusting column 5 for sloping bottom 3 is disclosed. Permanently fixed within mat 2 is lower leg portion 100 carrying lower spherical bearing 101. Lower leg portion extends upwardly above mat 2 with hollow tubular section 102 which terminates with internal upper spherical bearing pad 103 therein.

Located within each hollow tubular leg 6 is a rotatable shaft 104 having threaded portion 105 threaded into mating threads 106 fixedly fastened to internal surface of leg 6. Shaft 104 terminates at lower end in spherical bearing pad 107 seated in bearing seat 101. Protruding from shaft body above lower end 107 is, second, or upper spherical bearing pad 108 which bears against upper spherical bearing pad 103. Auxiliary rotatable side guide bearings 109 bear against shaft 104 to support it as shaft 104 rotates.

Attached to upper end of shaft 104 is first means 110 to rotate shaft 104. Splined onto upper end 111 of shaft 104 is first and second bevel gear 112 and 113 device of conventional design. Gear 113 engages gear 112. Gear 113 is rotated by sprocket 113(*a*) in response to chain connection 114 sprocketed and connected to conventional rotating device 114 (*a*) located on work platform. As shaft 104 rotates in threads 105 and 106, it forces mat 2 to adjust from horizontal to a sloped angle, when mat 2 is above bottom 3.

As will be appreciated, each leg 6 is similarly constructed so as to permit each leg 6 to be independently adjustable with respect to mat 2. As will be further appreciated, the sprocket and chain arrangement are preferred for use when mat is immediately adjacent surface 4 of water, to permit connection of chain to sprocket, and turning device 114 (*a*) on work platform.

Figure 13:
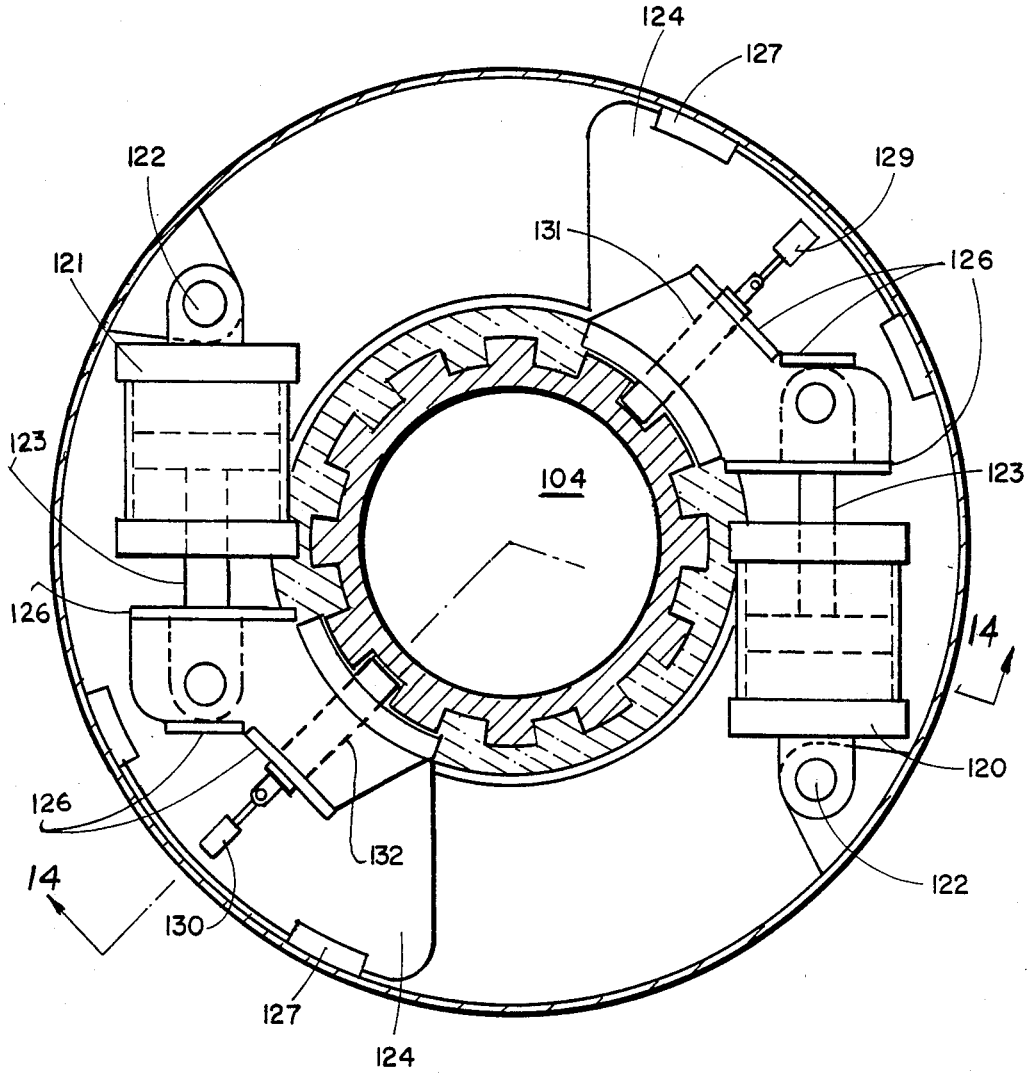
FIG. 13 is a plan view in cross section of a leg containing a second means for vertically adjusting the leg.
Figure 14:
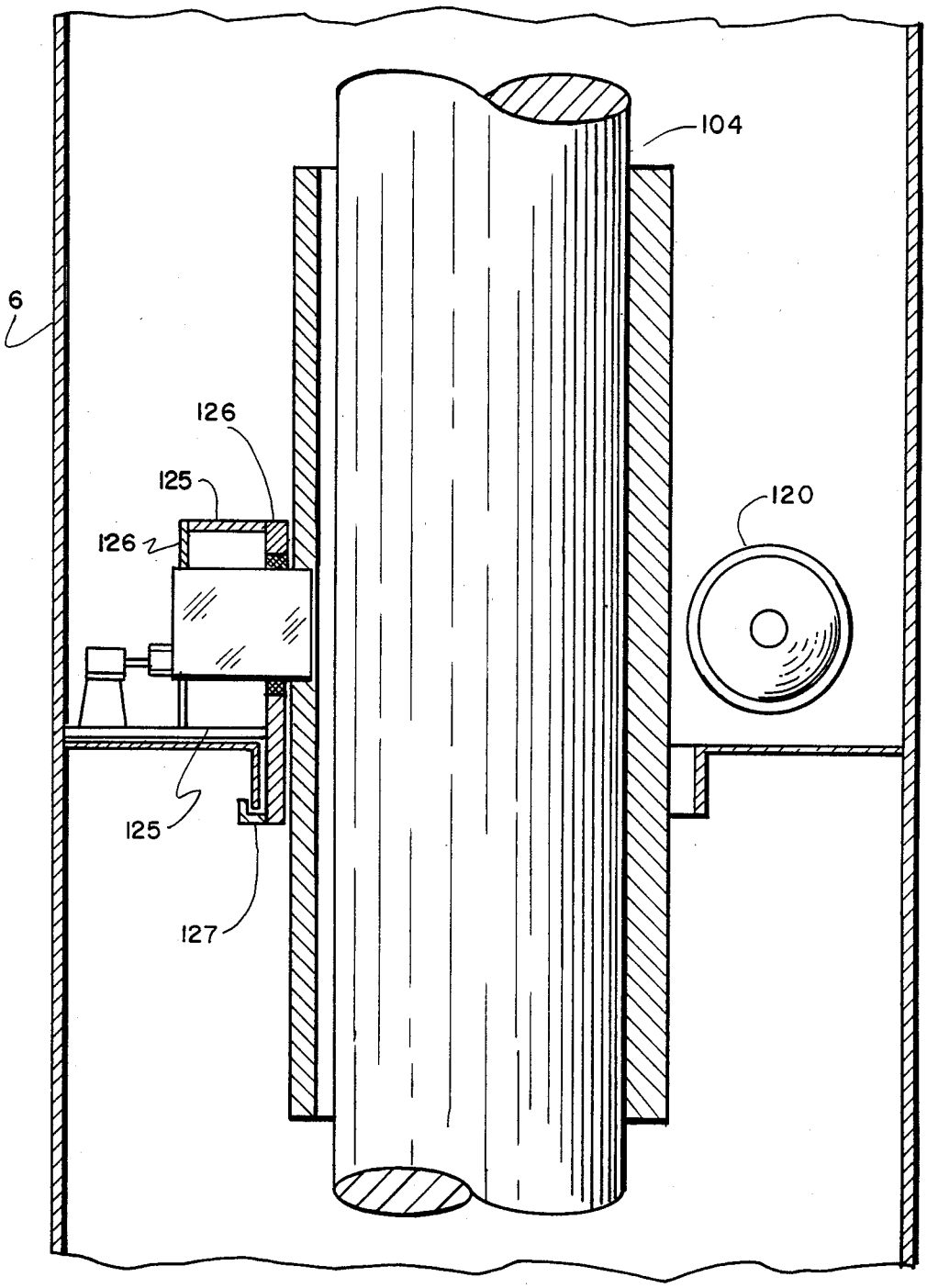
FIG. 14 is a section along lines 14—14 of FIG. 13.

When mat 2 is fully ballasted and/or located on bottom, a second means to turn shaft 104 is contemplated, as shown in FIGS. 13 and 14.

Located within each leg 6 is a pair of horizontally-oriented conventional hydraulic-operated cylinders 20 and 121, disposed diametrically opposite each other. Each cylinder is pivotally connected at one end 122 to internal wall portion of leg 6. Each shaft 123 of each cylinder is pivotally connected to a yoke 124. Yoke 124 is formed by two vertically spaced apart parallel horizontal plates 125 supported apart by vertical plates 126. Yoke 124 moves within yoke guides 127 fixed to legs 6. Fitted onto upper end of shaft 104 is splined jacking ring 128. A second pair of opposed horizontally-oriented jacking pin hydraulic cylinders 129 and 130 are pivotably disposed diametrically opposite each other. Cylinders 129 and 130 selectively insert jacking pin 131 and 132 into splined ring 128 in response to cylinder 129 or 130. Not shown are hydraulic lines which extend from each cylinder within leg 6, up leg 6 and thence to work platform 8, in order to operate cylinders 120, 121, 129 and 130 in conventional manner.

In operation, with jacking pins inserted into splines 128, cylinders 120 and 121 are operated to cause shaft 104 to turn. Jacking pins are withdrawn by cylinders 129 and 130, cylinders 120 and 121 are reversed, and pins 131, 132 are re-inserted into splines 128 for a new turning cycle. Direction of turn of shaft is controlled by direction of operation of cylinders 120, 121, as is well known.

Figure 19:
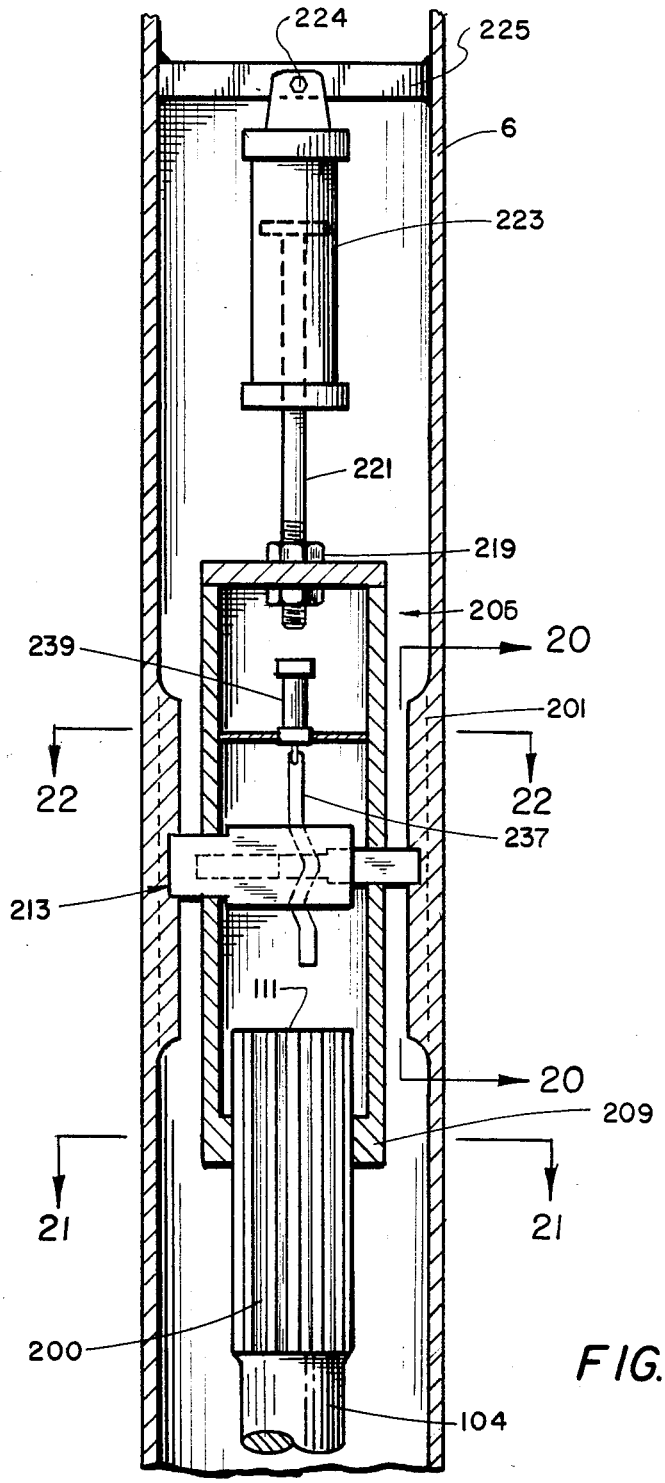
FIG. 19 is a schematic elevation in cross section of a leg containing a third means for vertically adjusting the leg.
Figure 19:
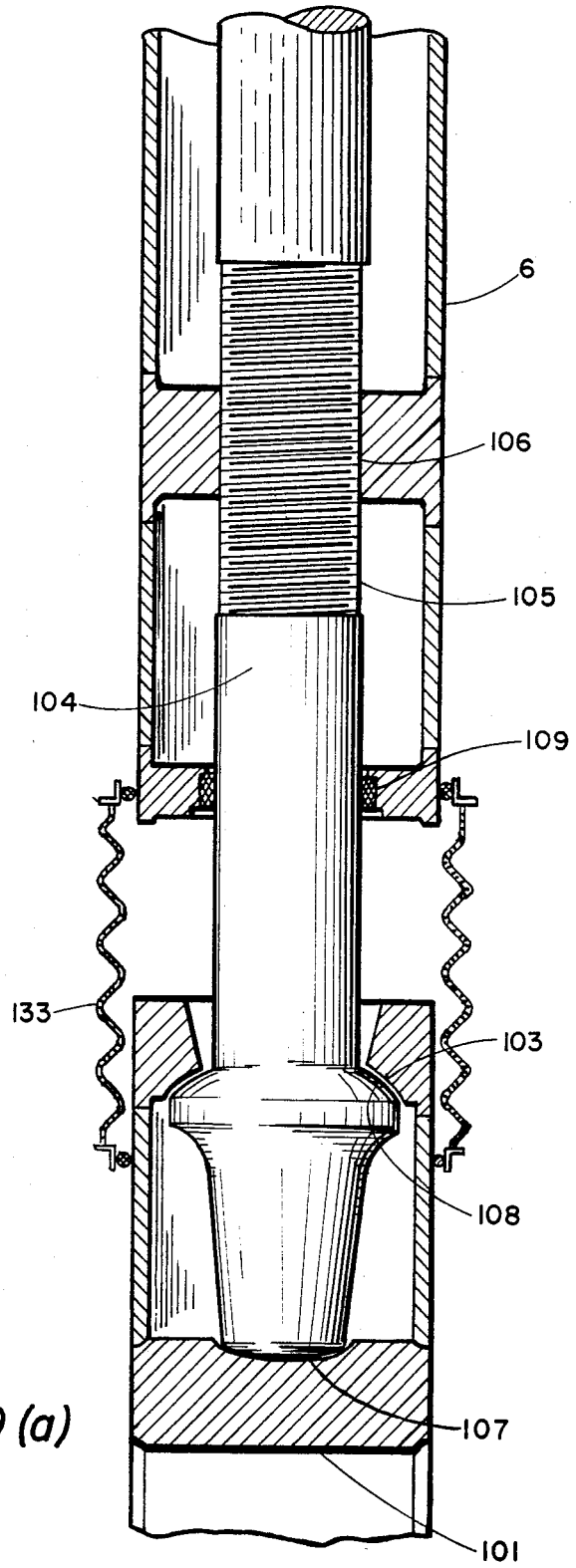

A third means to rotate shaft 104 is also shown in FIGS. 19–23. Referring particularly to FIGS. 19 and 19(*a*) there is shown hollow leg 6 having rotatable shaft 104 therein with threaded portion 105 engaging mating threads 106 on internal surface of leg 6. Shaft 104 has lower spherical bearing pad 107 seated in bearing seat 101, all as previously described. The other features such as upper bearing pad 103 and 108 and seal means 133 are also the same as previously described.

Figure 20:
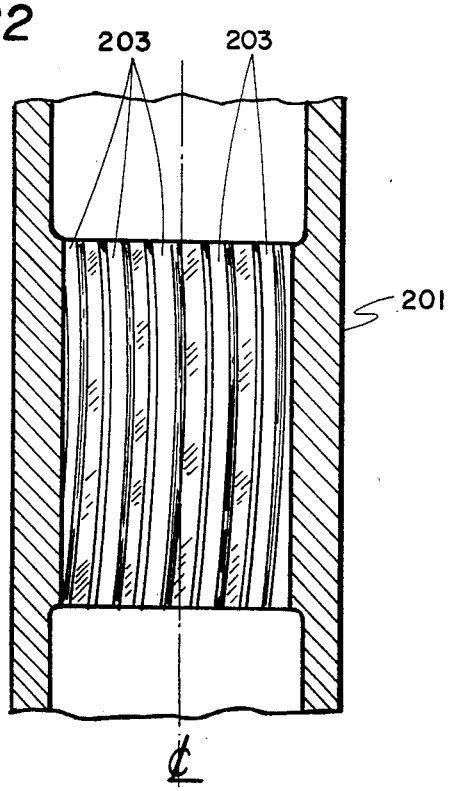
FIG. 20 is a section along lines 20—20 of FIG. 19.

Upper end 111 of shaft 10 includes a plurality of parallel grooves, or flutes, 200, which extend vertically along the shaft 104, parallel to the centerline of shaft 104. Flutes 200 are spaced around the circumference of shaft 104. Adjacent to and extending vertically above fluted end 111 is a wall portion 201 of leg 6 containing a plurality of parallel grooves 203 on the inner surface of wall portion 201. Since legs 6 are tubular (circular) in horizontal cross-section, wall portion 201 is likewise circular in horizontal cross-section and grooves 203 are formed in the inner surface of wall portion 201. As shown in FIG. 20, grooves 203 are angled away from centerline of leg 6 so as to gradually spiral away from the center line thereof. Such arrangement of grooves 203 is referred to herein as helical grooves spiralling downwardly along the length of wall portion 201.

Located within leg 6 and engaging both flutes 200 and grooves 203 is a hollow twist sleeve 205. Twist sleeve 205 engages flutes 200 by means of flute rider 209 on lower end thereof, which fluted rider 209 has projections 211 which engage each groove 203 (see FIGS. 19 and 21).

Twist sleeve 205 engages grooves 203 by means of horizontally reciprocally movable twist pin means 213, having a first and second blade 215, 217 extending through an aperture in twist sleeve 205, and respectively engaging grooves 203. Twist pin means 213 is horizontally expandable and contractable whereby blades 215, 217 can selectively engage and disengage grooves 203, for reasons which will be described hereinafter. Twist sleeve 205 is permanently fastened as by nut and bolt 219 to one end of a vertically reciprocable shaft 221 of a hydraulic cylinder 223. Cylinder 223 is pivotally fastened at 224 by conventional means to cross member 225 permanently affixed within leg 6.

In operation, vertical movement of twist sleeve 205 causes rotation of shaft 104 as a result of the combination of flute rider 209 engaging flutes 200 and blades 215, 217 engaging spiral grooves 203. Spiral grooves 203 cause twist sleeve 205 to rotate, as twist sleeve is vertically moved in response to cylinder 223.

When cylinder 223 has moved shaft 221 to an extreme position, either extended or withdrawn, it is necessary to reposition the shaft 221 for another stroke in order to continue rotation of shaft 104.

To reposition shaft 221, it is necessary to disengage blades 215, 217 from spiral grooves 203, thereby permitting twist sleeve 205 to be vertically moved without rotating shaft 104.

Figure 22:
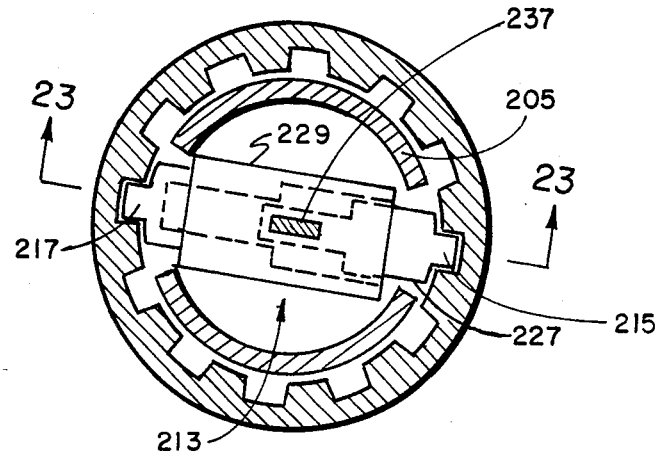
FIG. 22 is a section along lines 22—22 of FIG. 19.
Figure 21:
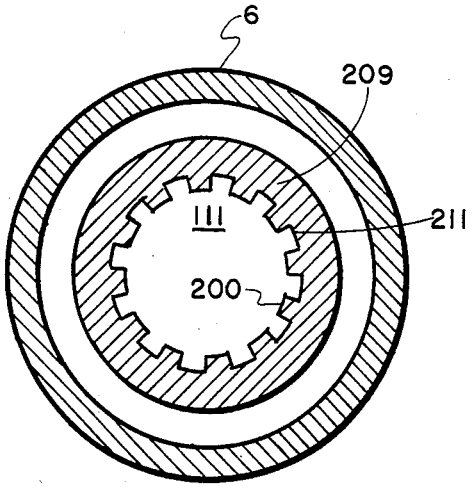
FIG. 21 is a section along lines 21—21 of FIG. 19.
Figure 23:
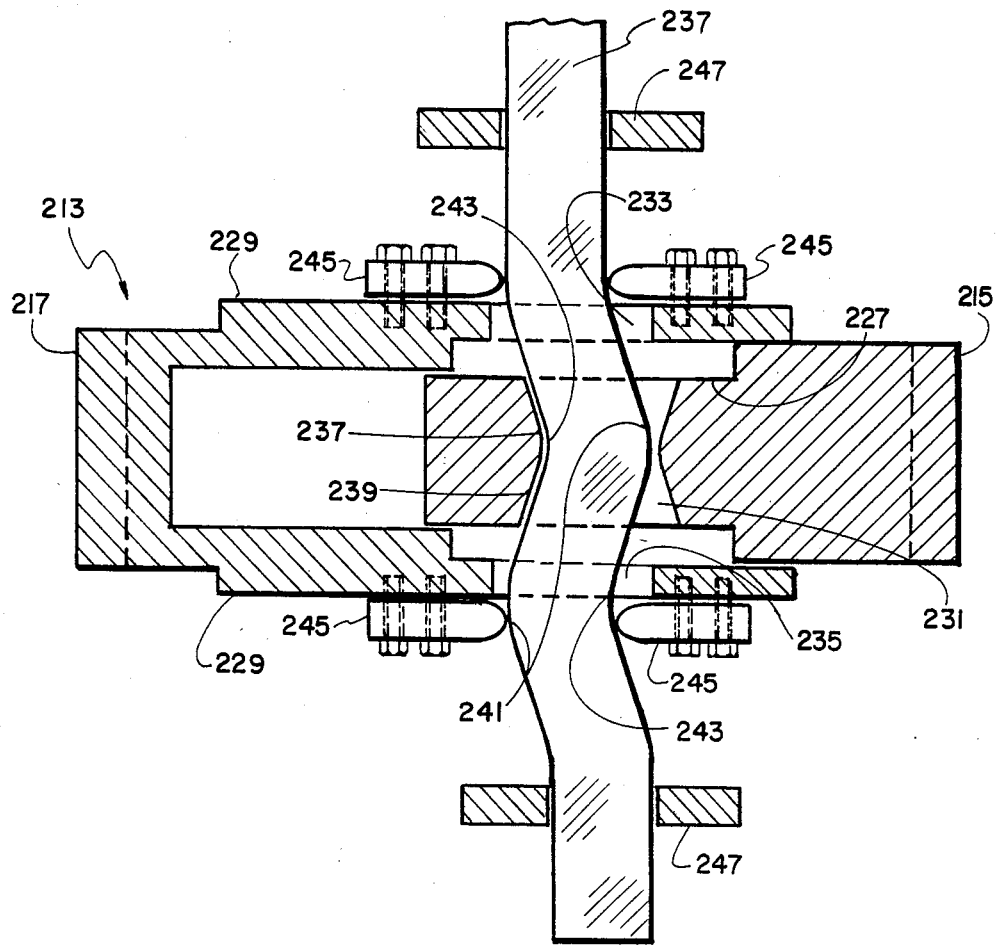
FIG. 23 is a section along lines 23—23 of FIG. 22.

As shown in FIGS. 22 and 23, twist pin means 213 includes a first and second blade 215, 217, which blades are horizontally reciprocal with respect to each other. I prefer to provide means for reciprocating blades 215,217 by providing one blade 215 as a male member with a rearwardly extending arm 227 which slidably moves within a female member, blade 217, formed by a pair of spaced apart rearwardly extending arms 229. An orifice 231 is positioned in arm 227 in matching relation with orifices 233, 235 in arms 229. Orifice 231 is formed by a first and second sloping surface 237, 239 which surfaces are angled toward each other in a convex relationship, as shown in vertical cross-section in FIG. 23. Extending vertically through orifices 231, 233, 235 is a twist pin expander rod 237 fastened to a vertically reciprocal cylinder 239 which is permanently mounted within twist sleeve 205. Means for activating both cylinders 223 and 239 are conventional and are not shown.

Expander rod 237 has an offset portion forming crests 241 and corresponding valleys 243. As expander rod 237 moves vertically, crests 241 press against surfaces 237, 239 causing blade 215 to reciprocate horizontally. Blade 217 is reciprocated likewise by the action of crests 241 against guide plates 245 fastened to ears 229 and extending into orifices 233, 235 to contact rod 237. Bearings 247 support rod 237.

The independent vertical adjustment of each leg 6 with respect to mat 2 is resisted by rigid bracing of column 5. The pivotally connected outer strut 90 and diagonal strut 95 permit the "flexing" of column 5 enough to allow a degree of independent horizontal movement for each leg 6 at its lowest point. At other vertical elevations 96, the required movement of cross braces is supplied by elastic deformation of cross braces. Of course, additional pivotal connections can be provided at other elevations 96, if so desired.

As shown in FIG. 12(*a*), lower terminus of leg 6 ends above raised section 102 of leg portion 100. Connecting leg 6 and raised portion 102 in water tight fashion is flexible, accordion seal means 133, sealing surrounding leg 6 at 134 such as by means of rubber gasket fitted against surface of leg portion 102 and lower terminus of leg 6. Likewise, seal 135 seals against raised portion 102. Located within water-tight leg 6 is a sealing fluid such as lubricating and corrosion protective oil. Sealing fluid is kept under pressure and in place against upper head plate 136, sealingly positioned inside leg 6. Not shown are optional means for lubricating bearing pad 103 and 101, 107 and 108. Accordion seal means is made from flexible metallic sheet and is vertically expandable and contractable. I prefer a vertical adjustment range of up to twelve feet.

Figure 16:
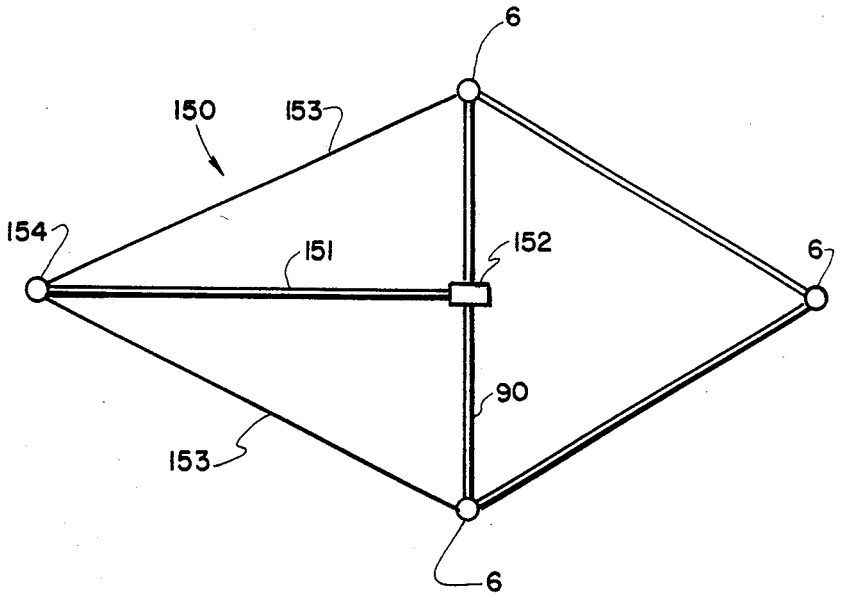
FIG. 16 is a section along line 16—16 of FIG. 15, with parts removed.
Figure 15:
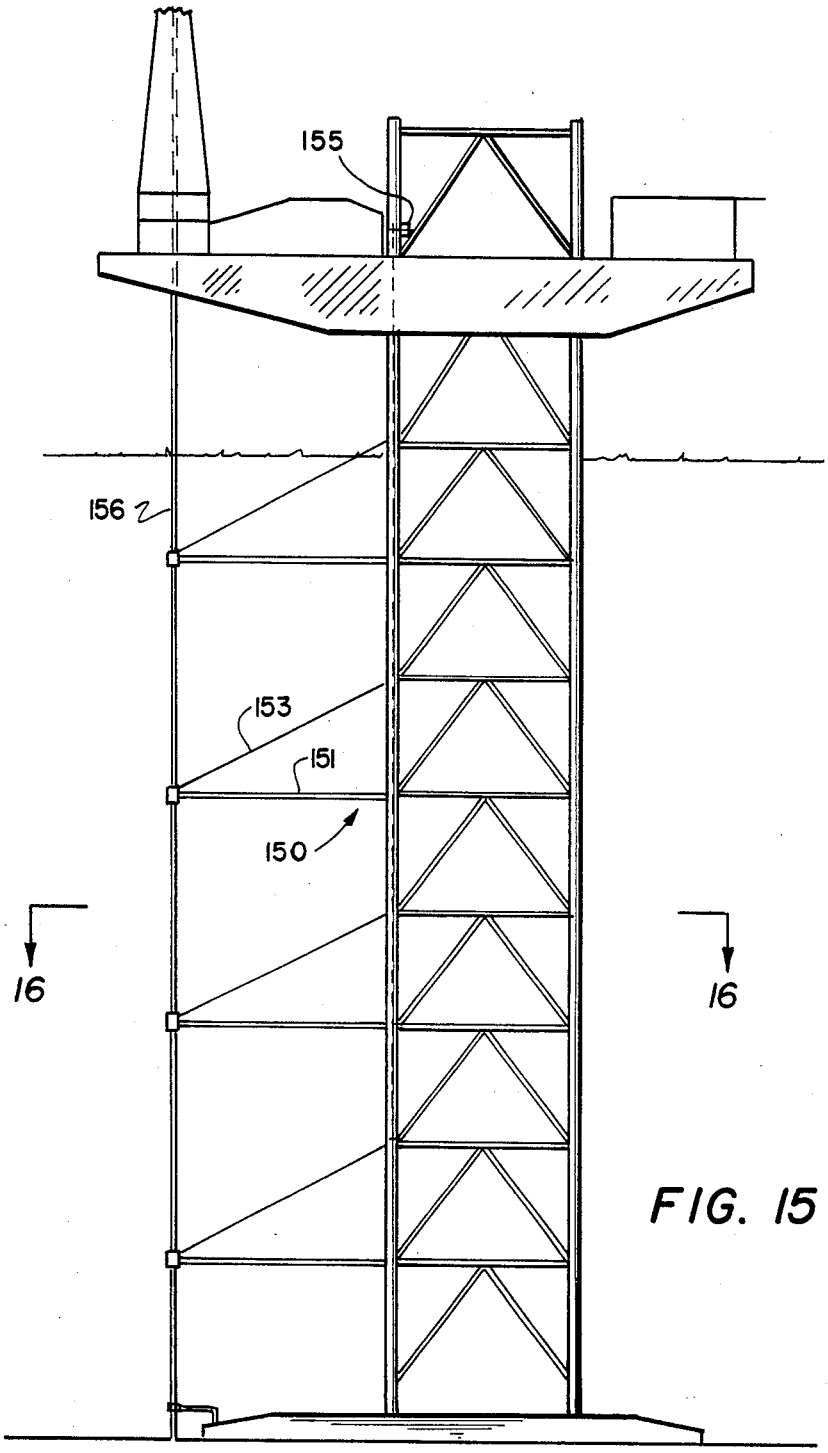
FIG. 15 is a schematic elevation showing the column with hinged riser guides attached thereto.

Another inventive feature is hinged riser guide 150, shown in FIG. 15 and 16. Riser guide 150 includes a support arm 151 pivotally fastened to column 5, by means of rotatable joint 152 connected to outer strut 90, 90 (*a*). Guy wires 153 extend from outer support ring 154 upward to a leg 6 above, and preferably up along leg 6 to control device 155, such as a winch means, located on work platform 8. Guy wires 153 pass over suitable pully means not shown. By shortening or lengthening guy wires 153, arm 151 can be raised or lowered.

A plurality of such hinged riser guides are provided at a plurality of vertical elevations along length of column 5. Riser pipe 156 extends through each outer support ring 154 and is supported thereby.

By providing the drilling platform as herein described, there is an advantageous combination of features for rigs to operate in deep water, approaching six hundred feet. The combination of ballastable apex end 42 oppositely located to fixed cantilevered arms 10, which arms are hollow adjacent the outer end 13 permits stability upon various cantilevered positions of movable skid unit. The work area 20 bounded by fixed cantilevered arms 10, inner edge 21 of work platform 8 and movable cantilevered skid unit 11 is substantially greater than that of conventional designs.

The single, cross braced column 5 being pivotally connected at each leg 6 to the mat 2 permits adjustment for sloping bottom 3. The combination of fixed and pivotable cross bracing permits independent vertical adjustment of each leg without inducing undue stress levels in cross bracing.

The first, second and third means for vertically adjusting each leg, sealed in fluid within each leg and providing universally tilting configurations by means of spherical bearing pads operably inter-connected permits adjustment for sloping bottom.

While I have disclosed apparatus on each leg 6 for vertically and independently adjusting each leg 6 with respect to the mat 2, it would be equivalent to pivotally connect each leg 6 to the mat 2, but provide means for vertically adjusting less than all of such legs 6. Such arrangement is less mechanically complicated and, therefore, less expensive to construct. The particular leg to be so adjustable is a matter of choice, depending upon which direction the column 5 is to be tiltable with respect to the sea floor slope.

I claim:

1. A mobile, offshore, jack-up, marine platform adjustable for sloping sea floor comprising:

(a) a mat;

(b) a tiltable column having a plurality of hollow tubular legs, each leg pivotally attached to the mat;

(i) means on at least one leg for independently vertically raising and lowering such leg with respect to the mat, to tilt the column;

(c) a jack-up work platform slidably mounted through its central portion on the column, the work platform having a pair of parallel fixed cantilevered arms extending outwardly from the central portion and a ballastable portion opposite the cantilevered arms;

(d) a skid unit movably mounted on the cantilevered arms of the work platform; and (e) a jack-up means interconnected between the work platform and each leg of the column for vertically moving the work platform with respect to the mat.

2. The invention of claim 1 further comprising:

(a) each jack-up means (e) including:

(i) a first and second vertically spaced semi-circular yoke spanning an outboard portion of each leg;
(ii) a plurality of vertically-oriented piston and cylinder assemblies interconnecting said first and second yokes; and
(iii) each yoke carrying a plurality of vertically-spaced, horizontally-oriented piston and cylinder assemblies which serve to selectively engage vertically-spaced apertures in the leg with reciprocating anchor pins.

3. The invention of claim 2 in which the legs of the column are cross-braced by:
(a) in a first horizontal plane adjacent the mat:
(i) a horizontally disposed outer strut connecting each pair of legs;
(ii) a pair of diagonal struts fastened to the midpoint of each outer strut, each diagonal strut extending downwardly to fixedly connect to a different leg of the pair of legs; and
(iii) the outer strut and diagonal struts being pivotally connected at the outer strut midpoint;
(b) in a plurality of horizontal planes above the first horizontal plane:
(i) outer struts similarly disposed to (a) (i);
(ii) diagonal struts similarly disposed to (a) (ii); and
(iii) the outer struts and diagonal struts being fixedly fastened to each other and to the legs of the column; and
(c) an inner strut connecting each pair of outer struts at the midpoint thereof, in a given plane.

4. The invention of claim 1 in which the means (b)(i) on each leg includes:
(a) a pivotal shaft rotatably threadably connected to the inside of the hollow leg, the shaft having means for pivoting in all directions as it rotates; and
(b) means for rotating the shaft to raise and lower the leg in relation to the mat.

5. The invention of claim 4 further including a plurality of hollow anchoring spuds extendable through the mat into the sea floor.

6. The invention of claim 5 wherein the column includes a plurality of riser supports at a plurality of vertical elevations pivotally connected to the column.

7. The invention of claim 1 in which the skid unit can be cantilevered out beyond the end of the fixed cantilevered arms.

8. The invention of claim 7 in which the skid unit is horizontally universally movable and carries a pipe storage rack.

9. The invention of claim 1 in which a pair of legs of the column are adjacent the fixed cantilevered arms, with a third leg oppositely spaced from the pair of legs, whereby the column, in horizontal cross-section, forms a triangle.

10. The invention of claim 9 in which the central portion of the work platform includes a plurality of compartments surrounding the column, wherein some of the compartments are ballastable.

11. The invention of claim 4 in which the means 4 (b) for rotating the shaft includes within the leg:
(a) a spline portion fixed to the shaft;
(b) a first pair of horizontally-oriented hydraulic cylinders in opposing relation pivotally fastened to the leg, for rotating the shaft;
(c) a pair of yokes pivotally fastened to the first pair of cylinders;
(d) a second pair of horizontally-oriented hydraulic cylinders in the yokes, for diametrically inserting and withdrawing a pair of jacking pins into the spline.

12. The invention of claim 4 in which the means 4 (b) for rotating the shaft includes:
(a) a first bevel gear affixed to the shaft;
(b) a second bevel gear engaged therewith and rotatably driven by a chain and sprocket combination extending from the work platform.

13. The invention of claim 4 in which means 4(b) for rotating the shaft includes within each leg:
(a) a leg portion having a plurality of helical grooves spiralling downwardly along the inner surface of the leg;
(b) a plurality of parallel vertical flutes on the upper end of the shaft;
(c) a vertically reciprocal twist sleeve having a first means for engaging the flutes, and a second means for selectively engaging and disengaging the helical grooves; and
(d) means for vertically reciprocating the twist sleeve.

14. The invention of claim 4 further including:
(a) a lower leg portion fixed to the mat, the lower leg portion carrying:
(i) a lower spherical bearing seat; and
(ii) an upper tubular section extending above the mat ending in an upper spherical bearing seat;
(b) the shaft terminating in a lower spherical bearing pad against lower spherical bearing seat and an upper spherical bearing pad against upper spherical bearing seat; and
(c) means for sealing between the lower portion of the leg and the upper tubular section.

* * * * *